US012584185B2

(12) United States Patent
Jo et al.

(10) Patent No.: US 12,584,185 B2
(45) Date of Patent: Mar. 24, 2026

(54) COLD-ROLLED STEEL SHEET HAVING EXCELLENT THERMAL-RESISTANCE AND MOLDABILITY, AND METHOD FOR MANUFACTURING SAME

(71) Applicant: POSCO, Pohang-si (KR)

(72) Inventors: Minho Jo, Pohang-si (KR); Young-Kwang Hong, Pohang-si (KR)

(73) Assignee: POSCO, Pohang-si (KR)

( * ) Notice: Subject to any disclaimer, the term of this patent is extended or adjusted under 35 U.S.C. 154(b) by 786 days.

(21) Appl. No.: 17/785,700

(22) PCT Filed: Dec. 14, 2020

(86) PCT No.: PCT/KR2020/018270
§ 371 (c)(1),
(2) Date: Jun. 15, 2022

(87) PCT Pub. No.: WO2021/125724
PCT Pub. Date: Jun. 24, 2021

(65) Prior Publication Data

US 2023/0074599 A1 Mar. 9, 2023

(30) Foreign Application Priority Data

Dec. 19, 2019 (KR) ..... 10-2019-0170977

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/005* (2013.01); *C21D 8/0205* (2013.01);
(Continued)

(58) Field of Classification Search
CPC ..... C22C 38/001; C22C 38/002; C22C 38/004; C22C 38/02; C22C 38/04; C22C 38/06;
(Continued)

(56) References Cited

FOREIGN PATENT DOCUMENTS

EP 1002884 A1 5/2000
EP 2405026 A1 1/2012
(Continued)

OTHER PUBLICATIONS

Extended European Search Report dated Jan. 20, 2023 issued in European Patent Application No. 20903946.0.
(Continued)

*Primary Examiner* — Lois L Zheng
(74) *Attorney, Agent, or Firm* — Morgan Lewis & Bockius LLP

(57) ABSTRACT

A cold-rolled steel sheet having excellent heat resistance and moldability according to an exemplary embodiment of the present invention includes 0.002 to 0.01 wt % of C, 0.1 to 1.0 wt % of Mn, less than 0.01 wt % (except for 0 wt %) of P, 0.01 wt % or less (except for 0 wt %) of N, 0.01 to 0.05 wt % of Nb, and 0.01 to 0.08% of Ti, with the balance being Fe and inevitable impurities, and has a microstructure in which the area fraction of recrystallized grains is 5 area % or less, and the dislocation density is $1\times10^{15}/m^2$ or less.

6 Claims, 1 Drawing Sheet

(51) Int. Cl.

| | |
|---|---|
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl.
CPC ..... *C21D 8/0226* (2013.01); *C21D 8/0236* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01)

(58) Field of Classification Search
CPC ..... C22C 38/12; C22C 38/14; C21D 1/26; C21D 6/005; C21D 8/0205; C21D 8/0226; C21D 8/0236; C21D 8/0247; C21D 8/0273; C21D 9/46; C23C 2/02; C23C 2/06; C23C 2/12; C23C 2/40
See application file for complete search history.

(56) References Cited

FOREIGN PATENT DOCUMENTS

| | | | | | |
|---|---|---|---|---|---|
| JP | H06-248339 | A | | 9/1994 | |
| JP | H08-085842 | A | | 4/1996 | |
| JP | 2007-520628 | A | | 7/2007 | |
| JP | 2010-150571 | A | | 7/2010 | |
| JP | 2010-229545 | A | | 10/2010 | |
| JP | 2012092427 | A | * | 5/2012 | ..... B32B 15/013 |
| JP | 6424908 | B2 | | 11/2018 | |
| KR | 10-1998-0033845 | A | | 8/1998 | |
| KR | 10-0286669 | B1 | | 4/2001 | |
| KR | 10-2003-0030032 | A | | 4/2003 | |
| KR | 10-0545086 | B1 | | 1/2006 | |
| KR | 10-2009-0068994 | A | | 6/2009 | |
| KR | 10-2012-0137931 | A | | 12/2012 | |
| WO | 2010/134616 | A1 | | 11/2010 | |
| WO | 2011/087107 | A1 | | 7/2011 | |
| WO | 2013/047821 | A1 | | 4/2013 | |

OTHER PUBLICATIONS

Japanese Office Action dated Oct. 3, 2023 issued in Japanese Patent Application No. 2022-538241.
International Search Report issued in corresponding International Application No. PCT/KR2020/018270 dated May 26, 2021, with English translation.

* cited by examiner

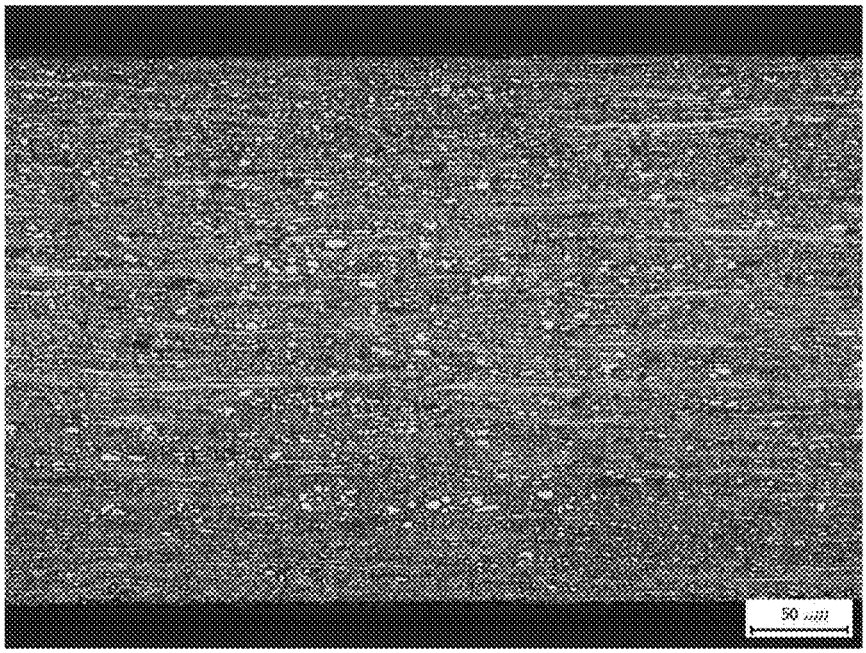
50 μm

COLD-ROLLED STEEL SHEET HAVING EXCELLENT THERMAL-RESISTANCE AND MOLDABILITY, AND METHOD FOR MANUFACTURING SAME

CROSS-REFERENCE OF RELATED APPLICATIONS

This application is the U.S. National Phase under 35 U.S.C. § 371 of International Patent Application No. PCT/KR2020/018270, filed on Dec. 14, 2020, which in turn claims the benefit of Korean Application No. 10-2019-0170977, filed on Dec. 19, 2019, the entire disclosures of which applications are incorporated by reference herein.

TECHNICAL FIELD

The present invention relates to a cold-rolled steel sheet having excellent heat resistance and moldability, and a method for manufacturing the same. Specifically, the present invention relates to a steel sheet used in an environment that may be exposed to heat after processing, in which the steel sheet has excellent heat resistance capable of maintaining the inherent strength thereof even at a high temperature and excellent moldability in which the steel sheet is capable of being processed as a structure of various forms, and a method for manufacturing the same.

BACKGROUND ART

Cold-rolled steel sheets are used as structural materials for many purposes such as building materials after various surface treatments. When a cold-rolled steel sheet is used as a structural material, the cold-rolled steel sheet has an advantage in that the amount of material used may be reduced because the cold-rolled steel sheet can withstand a high load for the same cross-sectional area when the strength is high. In particular, it is important to have a high yield strength because the load at which deformation begins is determined by the yield strength.

As a method for increasing the strength of a steel sheet, various methods such as solid solution strengthening, precipitation strengthening, work hardening, and hard phase control are used. Among them, the solid solution strengthening requires the addition of a large amount of alloying elements, and the method of controlling the hard phase also requires the addition of a large amount of alloying elements to enhance the curing ability or a quenching process after annealing, so that there is a disadvantage in that economic feasibility is reduced during manufacturing. Precipitation strengthening also requires the addition of expensive alloying elements to form precipitates, and has a disadvantage in that when the precipitates are formed in excess, cold rollability is significantly reduced.

Unlike the aforementioned methods, work hardening may be utilized as an economic method because no alloying element is added and the strength may be improved by the generation of high dislocations by simple cold rolling. However, since the dislocation density after work hardening is so high that moldability is significantly reduced and strength is again reduced by recrystallization during heat treatment at a temperature equal to or higher than the recrystallization temperature, there is a disadvantage in that heat resistance is inferior. In particular, when the heat resistance is inferior, the strength is reduced during exposure to the temperature for various hot dippings such as Zn and Al, so that it is difficult to use the cold-rolled steel sheet as a structural material that requires heat resistance such as high temperature piping. During exposure to a relatively high temperature Al plating bath for a certain period of time among plating baths, a large decrease in strength needs to be prevented.

As a method for overcoming such a disadvantage, there is a method of obtaining an elongation of a certain level or more by forming fine precipitates to increase the recrystallization temperature and performing recovery annealing at a temperature less than the recrystallization temperature. It is a method of preparing a high-strength steel by utilizing Ti and Nb which have a high recrystallization temperature improving effect to finely precipitate TiN, NbC, and TiC and performing recovery annealing. However, although the aforementioned technique adds a large amount of P in order to secure high strength, P has a disadvantage of making processing difficult by lowering the room temperature toughness, and reducing the uniformity of the structure of a final product. Further, in the aforementioned technique, the amount of Ti and Nb added is controlled as a ratio of Ti and Nb, but there is a need for controlling the contents of C and N together because the precipitation behavior of the precipitate is determined by the contents of C and N in addition to Ti and Nb.

DISCLOSURE

Technical Problem

Provided are a cold-rolled steel sheet having excellent heat resistance and moldability, and a method for manufacturing the same.

Specifically, provided are a steel sheet used in an environment that may be exposed to heat after processing, in which the steel sheet has excellent heat resistance capable of maintaining the inherent strength thereof even at a high temperature and excellent moldability in which the steel sheet is capable of being processed as a structure of various forms, and a method for manufacturing the same.

Technical Solution

A cold-rolled steel sheet having excellent heat resistance and moldability according to an exemplary embodiment of the present invention includes 0.002 to 0.01 wt % of C, 0.1 to 1.0 wt % of Mn, less than 0.01 wt % (except for 0 wt %) of P, 0.01 wt % or less (except for 0 wt %) of N, 0.01 to 0.05 wt % of Nb, and 0.01 to 0.08% of Ti, with the balance being Fe and inevitable impurities, and has a microstructure in which the area fraction of recrystallized grains is 5 area % or less, and the dislocation density is $1\times10^{15}/m^2$ or less.

The cold-rolled steel sheet having excellent heat resistance and moldability according to an exemplary embodiment of the present invention may further include one or more of 0.5 wt % or less (except for 0 wt %) of Si, 0.08 wt % or less (except for 0 wt %) of Al, and 0.01 wt % or less (except for 0 wt %) of S.

The cold-rolled steel sheet having excellent heat resistance and moldability according to an exemplary embodiment of the present invention may have a precipitation index of 10 or more as defined by the following Equation 1.

$$\text{Precipitation index}=[\text{Min}([Ti], [N])+4\times\text{Min}([Nb], [C])+2\times\text{Min}([Ti]-[N], [C]-[Nb])]\times10^4 \quad \text{[Equation 1]}$$

In this case, in Equation 1, [Ti], [N], [Nb], and [C] are a value obtained by dividing the content (wt %) of each component by each atomic weight thereof. Min(A, B) means the smaller value of A and B, and means 0 when Min(A, B) is a negative value.

The cold-rolled steel sheet having excellent heat resistance and moldability according to an exemplary embodiment of the present invention may have a yield strength of 450 MPa or more.

The cold-rolled steel sheet having excellent heat resistance and moldability according to an exemplary embodiment of the present invention may have an elongation of 4% or more.

An aluminum- or zinc-plated layer may be formed on the surface of the cold-rolled steel sheet having excellent heat resistance and moldability according to an exemplary embodiment of the present invention.

A method for manufacturing the cold-rolled steel sheet having excellent heat resistance and moldability according to an exemplary embodiment of the present invention includes: heating a slab including 0.002 to 0.01 wt % of C, 0.1 to 1.0 wt % of Mn, less than 0.01 wt % (except for 0 wt %) of P, 0.01 wt % or less (except for 0 wt %) of N, 0.01 to 0.05 wt % of Nb, and 0.01 to 0.08 wt % of Ti, with the balance being Fe and inevitable impurities; manufacturing a hot-rolled steel sheet by hot rolling the slab; manufacturing a cold-rolled steel sheet by cold rolling the hot-rolled steel sheet; and annealing the cold-rolled steel sheet at a temperature of 500° C. to $R_s$.

$R_s$ is the recrystallization initiation temperature, and is a temperature at which the area fraction of recrystallized grains is 5 area %.

In the heating of the slab, the slab may be heated to 1200° C. or more.

In the manufacturing of the hot-rolled steel sheet, a finishing rolling temperature may be $Ar_3$ or higher.

$Ar_3$ temperature may be calculated by the following equation.

$$Ar_3 \text{ temperature} = 910-(310\times[C])-(80\times[Mn])-(20\times[Cu])-(15\times[Cr])-(55\times[Ni])-(80\times[Mo])-(0.35\times(25.4-8))$$

In this case, [C], [Mn], [Cu], [Cr], [Ni], and [Mo] are the wt % of each element.

After the manufacturing of the hot-rolled steel sheet, a step of winding the hot-rolled steel sheet at 550 to 750° C. may be further included.

The manufacturing of the cold-rolled steel sheet may be manufacturing a cold-rolled steel sheet by cold rolling the wound hot-rolled steel sheet at a rolling reduction ratio of 50 to 95%.

After the manufacturing of the cold-rolled steel sheet, a step of plating the surface of the cold-rolled steel sheet with aluminum or zinc may be further included.

Advantageous Effect

The cold-rolled steel sheet having excellent heat resistance and moldability according to an exemplary embodiment of the present invention has excellent heat resistance and moldability while having economic feasibility because a large amount of expensive alloy components are not added.

The cold-rolled steel sheet having excellent heat resistance and moldability according to an exemplary embodiment of the present invention is a steel sheet used in an environment that may be exposed to heat after processing, and has heat resistance capable of maintaining the inherent strength thereof even at a high temperature and moldability in which the steel sheet is capable of being processed as a structure in various forms.

DESCRIPTION OF THE DRAWINGS

FIG. 1 is a photograph of the results of optical microscope microstructure observation of a cross section of a cold-rolled steel sheet having excellent heat resistance and moldability using Developed Steel 1 of the present invention.

MODE FOR INVENTION

Terms such as first, second and third are used to describe various parts, components, regions, layers and/or sections, but are not limited thereto. These terms are used only to distinguish one part, component, region, layer or section from another part, component, region, layer or section. Thus, a first part, component, region, layer, or section to be described below could be termed a second part, component, region, layer, or section within a range not departing from the scope of the present invention.

The terminology used herein is solely for reference to specific exemplary embodiments and is not intended to limit the present invention. The singular forms used herein also include the plural forms unless the phrases do not express the opposite meaning explicitly. As used herein, the meaning of "include" specifies a specific feature, region, integer, step, action, element and/or component, and does not exclude the presence or addition of another feature, region, integer, step, action, element, and/or component.

Further, unless otherwise specified, % means wt %, and 1 ppm is 0.0001 wt %.

In an exemplary embodiment of the present invention, further including an additional element means that the additional element is included while replacing iron (Fe) that is the balance by an additional amount of the additional element.

Although not differently defined, all terms including technical terms and scientific terms used herein have the same meaning as the meaning that is generally understood by a person with ordinary skill in the art to which the present invention pertains. The terms defined in generally used dictionaries are additionally interpreted to have the meaning matched with the related art document and currently disclosed contents, and are not interpreted to have an ideal meaning or a very formal meaning as long as the terms are not defined.

Hereinafter, exemplary embodiments of the present invention will be described in detail with reference to the accompanying drawings such that a person with ordinary skill in the art to which the present invention pertains can easily carry out the present invention. However, the present invention may be implemented in various different forms, and is not limited to the exemplary embodiments described herein.

The cold-rolled steel sheet having excellent heat resistance and moldability according to an exemplary embodiment of the present invention relates to a cold-rolled steel sheet used as various structural materials. The material for the corresponding use needs to secure moldability for making a shape and strength for maintaining the morphology of a structure. In addition, the material for the corresponding use has sufficient heat resistance, so that the strength thereof should not be reduced during surface treatment such as plating and coating or when used at high temperature.

When alloying elements are added in excessive amounts for the aforementioned physical characteristics, the cost of the material is increased, resulting in a decrease in economic feasibility. Therefore, there is a need for a method capable of simultaneously securing heat resistance and moldability without adding a large amount of expensive alloying elements.

The cold-rolled steel sheet having excellent heat resistance and moldability according to an exemplary embodiment of the present invention includes 0.002 to 0.01 wt % of C, 0.1 to 1.0 wt % of Mn, less than 0.01 wt % (except for 0 wt %) of P, 0.01 wt % or less (except for 0 wt %) of N, 0.01 to 0.05 wt % of Nb, and 0.01 to 0.08 wt % of Ti, with the balance being Fe and inevitable impurities.

Hereinafter, each component will be described in detail.

Carbon (C): 0.002 to 0.01 wt %

When the content of C is low, the strength thereof is low and it is difficult to use the steel sheet as a structural material, and in order to reduce the content excessively, an additional refining process is required, so that the productivity deteriorates. C may significantly improve strength by combining with Nb and Ti to precipitate Nb and Ti. In the present invention, the aforementioned content is sufficient as the content of C for obtaining the precipitation effect of NbC and TiC. When the content of C is too high, it may be difficult to prevent aging due to solid solution carbon. Accordingly, C may be included in an amount of 0.002 to 0.01 wt %. More specifically, C may be included in an amount of 0.002 to 0.0095 wt %.

Manganese (Mn): 0.1 to 1.0 wt %

Mn is an element that prevents the hot shortness caused by solid solution S by combining with solid solution S in steel to be precipitated as MnS. In order to obtain such an effect, Mn may be included in an amount of 0.1 wt % or more. However, when Mn is added in too large an amount, the material may be cured to reduce the ductility. Further, when Mn is added in too small an amount, the solid-soluted S is not sufficiently precipitated as MnS, so that there is a disadvantage in that brittleness is remarkably increased during hot rolling. Accordingly, Mn may be included in an amount of 0.1 to 1.0 wt %. More specifically, Mn may be included in an amount of 0.15 to 0.35 wt %, more specifically 0.18 to 0.22 wt %.

Phosphorus (P): Less than 0.01 wt % (Except for 0 wt %)

P is an element capable of increasing the strength without significantly reducing the ductility of steel when the element is added in a certain amount or less, but when P is added in a large amount, the element is segregated at the crystal grain boundaries to excessively harden steel and reduce the elongation, so that the amount of P may be limited to less than 0.01 wt %. In addition, when a large amount of P is added, P has disadvantages of makes processing difficult by reducing the room temperature toughness, and reducing the uniformity of the structure of a final product, so that the moldability and uniformity of a steel sheet may deteriorate. More specifically, the amount of P may be 0.008 wt % or less. Even more specifically, the amount of P may be 0.006 wt % or less.

Nitrogen (N): 0.01 wt % or Less (Except for 0 wt %)

N is contained as an inevitable element in steel, and may be combined with Ti to be used for precipitation hardening in the present invention. However, N, which is not precipitated and is present in a solid-solution state because the element is contained in an excessive amount, not only reduces ductility and degrades aging resistance, but also reduces moldability. Therefore, the amount of N may be 0.01 wt % or less in consideration of the content that may be combined with Ti to be all precipitated. More specifically, the amount of N may be 0.009 wt % or less.

Titanium (Ti): 0.01 to 0.08 wt %

Ti may be effectively used to increase the strength by combining with C and N to precipitate C and N. In addition, such precipitates are finely dispersed in steel, and the precipitates interfere with the dislocation and the movement of crystal grains during annealing after cold rolling, so that the recrystallization temperature may be increased. Since an increase in the recrystallization temperature has a direct effect on the improvement of heat resistance, it is very important to increase the recrystallization temperature in the present invention. To obtain a visible effect, Ti may be added in an amount of 0.01 wt % or more. When Ti is added in too small an amount, the amount of precipitate formed is small, so that there is disadvantage in that the effect of increasing strength and improving heat resistance is insignificant. When added in an excessive amount, Ti is present in a solid solution state without combining with C and N, and Ti present in a solid solution state has little effect of enhancing strength and increasing recrystallization temperature and reduces economic feasibility, so that the upper limit thereof may be 0.08 wt %. More specifically, the amount of Ti may be 0.01 to 0.07 wt %.

Niobium (Nb): 0.01 to 0.05 wt %

Nb is a precipitation strengthening element such as Ti, and has a relatively large effect of increasing strength and recrystallization temperature compared to Ti. When Nb is added in combination with Ti, TiN, NbC, and TiC are precipitated in this order by cooling the steel from a high temperature. Accordingly, the effect of increasing strength and recrystallization temperature becomes even greater. In the present invention, when a component system is given, a precipitation index proportional to the degree of precipitation formation was developed in consideration of the calculation of the contents of TiN, NbC and TiC and the relative effect of each precipitate. The precipitation index will be described below. It was confirmed that the appropriateness of the component system for obtaining the effects of increasing the recrystallization temperature and increasing the strength may be primarily verified from the precipitation index. When Nb is added in too small an amount, there are disadvantages in that the effect of improving strength and increasing recrystallization temperature is insignificant because the formation of precipitates is small. In contrast, when Nb is added in an excessive amount, the load of hot rolling is excessively increased, so that the content thereof may be limited to 0.05 wt %. More specifically, the content may be 0.01 to 0.045 wt %, more specifically 0.015 to 0.025 wt %.

The cold-rolled steel sheet having excellent heat resistance and moldability according to an exemplary embodiment of the present invention may further include one or more of 0.5 wt % or less (except for 0 wt %) of Si, 0.08 wt % or less (except for 0 wt %) of Al, and 0.01 wt % or less (except for 0 wt %) of S.

Silicon (Si): 0.5 wt % or Less (Except for 0 wt %)

Si is an element that can be used as a decarburizing agent, and may contribute to improving strength by solid solution strengthening. However, when Si is added excessively, Si-based oxides are generated on the surface during annealing, so that platability may be reduced by inducing defects during plating. More specifically, the amount of Si may be 0.3 wt % or less. Even more specifically, the amount of Si may be 0.01 to 0.1 wt %.

Aluminum (Al): 0.08 wt % or Less (Except for 0 wt %)

Al is an element having a very large deoxidizing effect and reacts with N in steel to precipitate AlN, thereby preventing degradation of moldability due to solid solution N. However, when Al is added in large amounts, the ductility may be rapidly reduced. More specifically, the amount of Al may be 0.01 to 0.05 wt %.

Sulfur (S): 0.01 wt % or Less (Except for 0 wt %)

S is an element that induces hot shortness during solid solution, but since it is difficult to completely remove S in the steelmaking process, the precipitation of MnS needs to be induced through the addition of Mn. The precipitation of excessive MnS is undesirable because the precipitation hardens the steel. The amount of S may be specifically 0.002 to 0.009 wt % in consideration of productivity and physical properties.

In addition to the above-described alloy composition, the balance includes Fe and inevitable impurities. However, in an exemplary embodiment of the present invention, the addition of other compositions is not excluded. The aforementioned inevitable impurities may be unintentionally incorporated from raw materials or the surrounding environment in a typical steel manufacturing process, and cannot be excluded. The aforementioned inevitable impurities may be understood by those skilled in the typical steel manufacturing field. For example, the inevitable impurities may be 0.02 wt % or less of Cr, 0.02 wt % or less of Ni, 0.02 wt % or less of Cu, and 0.01 wt % or less of Mo.

The cold-rolled steel sheet having excellent heat resistance and moldability according to an exemplary embodiment of the present invention has a microstructure in which the area fraction of recrystallized grains is 5 area % or less, and the dislocation density is $1\times10^{15}/m^2$ or less.

The area fraction of recrystallized grains means the area fraction of the recrystallized grains compared to the total area of the cross section of the cold-rolled steel sheet. The total area of the cross section and the area of the recrystallized grains may be measured from the optical microstructure observation and the electron backscatter diffraction (EBSD) observation of the cross section of the steel sheet.

Here, the recrystallized grain means a crystal grain formed by recrystallization. In the present invention, the recrystallized grain means a crystal grain recrystallized by annealing a cold-rolled steel sheet.

A part except for the crystal grains recrystallized by annealing may be defined as an unrecrystallized grain, and the crystal grain and the unrecrystallized grain may be classified into shape and orientation characteristics. The unrecrystallized grains have the characteristic of being elongated in the rolling direction, and the orientation is unclear in the crystal grains, whereas the recrystallized grains have the characteristic of being relatively close to a sphere, and the orientation of the crystal grains is clear.

Meanwhile, the dislocation density means the number of dislocations passing through a unit area. The dislocation density may be measured through XRD and may be quantitatively measured from changes in the position and width of the peak according to the dislocation density.

When recovery annealing is performed at an annealing temperature (500° C. to $R_s$; here, $R_s$ is the recrystallization initiation temperature, and means a temperature at which the area fraction of recrystallized grains is 5 area % during the annealing of a cold-rolled steel sheet.) of a cold-rolled steel sheet to be described below, the area fraction of recrystallized grains is 5 area % or less, and the dislocation density is $1\times10^{15}/m^2$ or less. When the recrystallization is excessively performed, and thus the surface fraction of recrystallized grains is high, there is a disadvantage in that the strength of the steel sheet is lowered. Further, even though the area fraction of recrystallized grains is 5 area % or less, when the dislocation density is too large, the strength of the steel sheet is high, but the elongation is low, so that the moldability deteriorates.

The area fraction of recrystallized grains may be more specifically 4.7 area % or less.

The dislocation density may be more specifically $9\times10^{14}/m^2$ or less, even more specifically 5 to $10\times10^{14}/m^2$, and even much more specifically 5 to $9\times10^{14}/m^2$.

The cold-rolled steel sheet having excellent heat resistance and moldability according to an exemplary embodiment of the present invention may have a precipitation index of 10 or more as defined by the following Equation 1. Specifically, the precipitation index may be 10 to 20.

$$\text{Precipitation index}=[\text{Min}([Ti], [N])+4\times\text{Min}([Nb], [C])+2\times\text{Min}([Ti]-[N], [C]-[Nb])]\times10^4 \quad \text{[Equation 1]}$$

In Equation 1, [Ti], [N], [Nb], and [C] are a value obtained by dividing the content (wt %) of each component by each atomic weight thereof. Min(A, B) means the smaller value of A and B, and means 0 when Min(A, B) is a negative value.

Specifically, [Ti] means (content of Ti)/47.867, [N] means (content of N)/14.007, [Nb] means (content of Nb)/92.906, and [C] means (content of C)/12.011.

In the present invention, Nb and Ti are added as alloy components, and Nb and Ti are precipitated in the order of TiN, NbC, and TiC when steel is cooled from a high temperature. Accordingly, the effect of increasing strength and recrystallization temperature becomes even greater. In the present invention, when a component system is given, a precipitation index proportional to the degree of precipitation formation was developed in consideration of the calculation of the contents of TiN, NbC and TiC and the relative effect of each precipitate. That is, the precipitation index may be proportional to the degree of precipitation formation. The appropriateness of the component system for obtaining the effects of increasing the recrystallization temperature and increasing the strength may be primarily verified from the precipitation index.

The cold-rolled steel sheet having excellent heat resistance and moldability according to an exemplary embodiment of the present invention may have a yield strength of 450 MPa or more and may have an elongation of 4% or more. Further, the cold-rolled steel sheet may be a plated steel sheet in which an aluminum- or zinc-plated layer is formed on the surface of the cold-rolled steel sheet.

The method for manufacturing a cold-rolled steel sheet having excellent heat resistance and moldability according to an exemplary embodiment of the present invention includes: heating a slab; manufacturing a hot-rolled steel sheet by hot rolling the slab; manufacturing a cold-rolled steel sheet by cold rolling the hot-rolled steel sheet; and annealing the cold-rolled steel sheet at a temperature of 500° C. to $R_s$.

Hereinafter, the method will be specifically described for each step.

First, a slab is heated.

Since the alloy composition of the slab has been described in detail in the above-described cold-rolled steel sheet, the duplicate description thereof will be omitted. Since the alloy composition is not substantially changed in the process of manufacturing the cold-rolled steel sheet having excellent heat resistance and moldability, the alloy composition of the cold-rolled steel sheet and the alloy composition of the slab are substantially the same as each other.

The heating temperature of the slab may be 1200° C. or higher. Since most of the precipitates present in steel need to be again subjected to solid solution, a temperatures of 1200° C. or higher may be required. More specifically, the heating temperature of the slab may be 1250° C. or higher.

Next, a hot-rolled steel sheet is manufactured by hot rolling the slab.

In this case, a finishing rolling temperature may be $Ar_3$ or higher.

$Ar_3$ temperature may be calculated by the following equation.

$$Ar_3 \text{ temperature}=910-(310\times[C])-(80\times[Mn])-(20\times[Cu])-(15\times[Cr])-(55\times[Ni])-(80\times[Mo])-(0.35\times(25.4-8))$$

In this case, [C], [Mn], [Cu], [Cr], [Ni], and [Mo] are the wt % of each element.

This is for performing rolling in the single-phase region of austenite.

After the manufacturing of the hot-rolled steel sheet, a step of winding the hot-rolled steel sheet at 550 to 750° C. may be further included. Since the N remaining in the solid solution state may be additionally precipitated as AlN by winding the hot-rolled steel sheet at 550° C. or higher, excellent aging resistance may be secured. When the hot-rolled steel sheet is wound at less than 550° C., there is a risk that N is not precipitated as AlN and workability is reduced by the remaining solid solution N. When the hot-rolled steel sheet is wound at 750° C. or higher, the crystal grains are coarsened, so that the coarse crystal grains may be a factor of lowering the cold rollability.

After the manufacturing of the hot-rolled steel sheet, a cold-rolled steel sheet is manufactured by cold rolling the hot-rolled steel sheet. In this case, the rolling reduction ratio may be 50 to 95%. The rolling reduction ratio determines the final thickness of the cold-rolled steel sheet, and when the rolling reduction is less than 50%, it may be difficult to secure a final target thickness, and when the rolling reduction ratio is more than 95%, the rolling load is high, so that it may be difficult to perform cold rolling.

After the manufacturing of the cold-rolled steel sheet, the cold-rolled steel sheet is annealed at a temperature of 500° C. to $R_s$. The annealing in this case may mean a recovery annealing. Further, $R_s$ is the recrystallization initiation temperature, and is defined as a temperature at which the area fraction of recrystallized grains is 5 area %. $R_s$ may be confirmed by measuring the fraction of recrystallized grains according to the annealing temperature of the cold-rolled steel sheet which has been cold rolled. By performing the recovery annealing at a temperature equal to or lower than the recrystallization annealing temperature, a considerable amount of dislocations accumulated during cold rolling are removed. This improves the elongation. When the cold-rolled steel sheet is annealed at an extremely low temperature, the dislocations generated during cold rolling may not be sufficiently eliminated, so that the ductility may deteriorate. In contrast, when the cold-rolled steel sheet is annealed at $R_s$ or higher, the elongation is significantly improved by recrystallization, but the strength may be sharply reduced. More specifically, the annealing temperature may be 600 to 800° C.

Furthermore, the annealing time at a temperature of 500° C. to $R_s$ may be 10 to 300 seconds. More specifically, the annealing time may be 20 to 60 seconds. When the annealing time is too short, there is a disadvantage in that it is difficult to remove dislocations, whereas when the annealing time is too long, the recrystallization fraction is increased, so that there is a disadvantage in that the cold-rolled steel sheet becomes soft.

Meanwhile, the annealing process may be a batch annealing or continuous annealing process.

In addition, after the annealing, a shape may be corrected by performing a skin-pass rolling of 2% or less, but physical properties can be implemented without performing any skin-pass rolling.

Hereinafter, the present invention will be described in more detail through the examples. However, such examples are merely for exemplifying the present invention, and the present invention is not limited thereto.

EXAMPLES

A steel with the composition shown in the following Table 1 was manufactured, and the components exhibit actual values. A steel slab having the composition shown in Table 1 was reheated to 1250° C., hot rolled at 900° C. or higher, wound at 650° C., and cold rolled at a rolling reduction ratio of 70%.

TABLE 1

| Steel | Component (wt %) | | | | | | | | |
|---|---|---|---|---|---|---|---|---|---|
| type | C | Si | Mn | Al | P | S | N | Nb | Ti |
| A | 0.0035 | 0.068 | 0.186 | 0.046 | 0.0044 | 0.0032 | 0.0037 | 0.020 | 0.033 |
| B1 | 0.0011 | 0.045 | 0.220 | 0.046 | 0.0041 | 0.0056 | 0.0038 | 0.020 | 0.029 |
| B2 | 0.0058 | 0.062 | 0.209 | 0.032 | 0.0059 | 0.0035 | 0.0029 | 0.017 | 0.027 |
| B3 | 0.0090 | 0.065 | 0.185 | 0.030 | 0.0047 | 0.0062 | 0.0027 | 0.022 | 0.028 |
| B4 | 0.0115 | 0.053 | 0.219 | 0.029 | 0.0054 | 0.0063 | 0.0032 | 0.021 | 0.030 |
| C1 | 0.0034 | 0.060 | 0.802 | 0.024 | 0.0047 | 0.0066 | 0.0022 | 0.025 | 0.028 |
| C2 | 0.0028 | 0.058 | 1.352 | 0.031 | 0.0051 | 0.0062 | 0.0033 | 0.021 | 0.032 |
| C3 | 0.0031 | 0.064 | 0.051 | 0.036 | 0.0041 | 0.0045 | 0.0033 | 0.020 | 0.031 |
| D1 | 0.0030 | 0.044 | 0.216 | 0.048 | 0.0155 | 0.0044 | 0.0036 | 0.017 | 0.029 |
| D2 | 0.0033 | 0.054 | 0.187 | 0.033 | 0.0238 | 0.0066 | 0.0023 | 0.017 | 0.034 |
| E1 | 0.0033 | 0.042 | 0.218 | 0.042 | 0.0049 | 0.0052 | 0.0080 | 0.023 | 0.033 |
| E2 | 0.0026 | 0.062 | 0.212 | 0.034 | 0.0048 | 0.0063 | 0.0112 | 0.020 | 0.033 |
| F1 | 0.0030 | 0.038 | 0.188 | 0.047 | 0.0055 | 0.0054 | 0.0024 | 0.005 | 0.034 |
| F2 | 0.0029 | 0.043 | 0.191 | 0.027 | 0.0057 | 0.0070 | 0.0031 | 0.020 | 0.027 |
| F3 | 0.0025 | 0.044 | 0.188 | 0.048 | 0.0059 | 0.0038 | 0.0033 | 0.040 | 0.028 |
| F4 | 0.0031 | 0.052 | 0.199 | 0.035 | 0.0054 | 0.0061 | 0.0035 | 0.083 | 0.032 |
| G1 | 0.0026 | 0.050 | 0.183 | 0.045 | 0.0042 | 0.0031 | 0.0021 | 0.020 | 0.005 |
| G2 | 0.0034 | 0.065 | 0.213 | 0.033 | 0.0052 | 0.0069 | 0.0037 | 0.019 | 0.015 |
| G3 | 0.0028 | 0.066 | 0.184 | 0.023 | 0.0053 | 0.0038 | 0.0038 | 0.021 | 0.068 |

For the manufactured cold-rolled steel sheet, $R_s$ (recrystallization initiation temperature) was measured as shown in the following Table 2. The recrystallization initiation temperature is determined as a temperature at which the area fraction of recrystallized grains is 5 area %. Annealing was performed by setting an annealing temperature in consideration of the recrystallization temperature, thereby manufacturing an annealed steel sheet. Since the steel components are different, it can be confirmed that there is a difference in the recrystallization initiation temperature.

TABLE 2

| Classification | Steel type | Rs (° C.) | Annealing temperature (° C.) |
|---|---|---|---|
| Developed Steel 1 | A | 670 | 665 |
| Comparative Steel 1 | A | 670 | 480 |
| Developed Steel 2 | A | 670 | 630 |
| Comparative Steel 2 | A | 670 | 680 |
| Comparative Steel 3 | A | 670 | 700 |
| Comparative Steel 4 | B1 | 610 | 605 |
| Developed Steel 3 | B2 | 690 | 685 |
| Developed Steel 4 | B3 | 720 | 715 |
| Comparative Steel 5 | B4 | 715 | 710 |
| Developed Steel 5 | C1 | 670 | 665 |
| Comparative Steel 6 | C2 | 660 | 655 |
| Comparative Steel 7 | C3 | 660 | 665 |
| Comparative Steel 8 | D1 | 680 | 675 |
| Comparative Steel 9 | D2 | 680 | 675 |
| Developed Steel 6 | E1 | 700 | 695 |
| Comparative Steel 10 | E2 | 690 | 685 |
| Comparative Steel 11 | F1 | 620 | 615 |
| Developed Steel 7 | F2 | 660 | 655 |
| Developed Steel 8 | F3 | 655 | 650 |
| Comparative Steel 12 | F4 | 680 | 675 |
| Comparative Steel 13 | G1 | 640 | 635 |
| Developed Steel 9 | G2 | 665 | 660 |
| Developed Steel 10 | G3 | 665 | 660 |

For the manufactured annealing steel sheet, precipitation index, recrystallization area fraction, dislocation density, yield strength, elongation, aging properties, and heat resistance were calculated and measured, and are shown in the following Table 3.

The precipitation index was calculated by the following Equation 1.

$$\text{Precipitation index}=[\text{Min}([\text{Ti}],[\text{N}])+4\times\text{Min}([\text{Nb}],[\text{C}])+2\times\text{Min}([\text{Ti}]-[\text{N}],[\text{C}]-[\text{Nb}])]\times10^4 \quad \text{[Equation 1]}$$

In Equation 1, [Ti], [N], [Nb], and [C] are a value obtained by dividing the content (wt %) of each component by each atomic weight thereof. Min(A, B) means the smaller value of A and B, and was calculated as 0 when Min(A, B) is a negative value.

Specifically, [Ti] was calculated as (content of Ti)/47.867, [N] was calculated as (content of N)/14.007, [Nb] was calculated as (content of Nb)/92.906, and [C] was calculated as (content of C)/12.011.

The surface fraction of the recrystallized grains after annealing was measured from the optical microstructure observation results of the cross section of the steel sheet. FIG. 1 is a photograph of the results of optical microstructure observation of an exemplary embodiment of the present invention. In FIG. 1, the spherical bright region is a recrystallized part. An area fraction thereof was obtained.

The dislocation density was measured through X-ray diffraction (XRD), and measured from a change in the measured peak width.

Yield strength and elongation were measured through a room temperature tensile test, and measured by subjecting a plate type sample in the rolling direction to a tensile test.

In order to confirm the soundness against aging, the temperature was maintained at 100° C. for 1 hour, and the soundness was indicated as good when the yield strength increased by 30 MPa or less and poor when the yield increased by more than 30 MPa.

After the sample was maintained at 650° C. for 10 minutes, heat resistance was indicated as good when the sample had a yield strength of 500 MPa or more, and as poor when the sample had a yield strength of less than 500 MPa.

TABLE 3

| Classification | Precipitation index Equation 1 | Area fraction of recrystallized grains (area %) | Dislocation density ($X10^{14}/m^2$) | Yield strength (MPa) | Elongation (%) | Aging properties | Heat resistance |
|---|---|---|---|---|---|---|---|
| Developed Steel 1 | 12.77 | 4.407 | 8.5 | 538.0 | 5.4 | Good | Good |
| Comparative Steel 1 | 12.77 | 0.000 | 14.2 | 658.0 | 1.8 | Good | Good |
| Developed Steel 2 | 12.77 | 0.000 | 8.2 | 558.0 | 4.1 | Good | Good |
| Comparative Steel 2 | 12.77 | 10.200 | 2.1 | 400.2 | 11.2 | Good | Poor |
| Comparative Steel 3 | 12.77 | 85.200 | 0.1 | 320.5 | 27.2 | Good | Poor |

TABLE 3-continued

| Classification | Precipitation index Equation 1 | Area fraction of recrystallized grains (area %) | Dislocation density ($X10^{14}/m^2$) | Yield strength (MPa) | Elongation (%) | Aging properties | Heat resistance |
|---|---|---|---|---|---|---|---|
| Comparative Steel 4 | 6.38 | 3.390 | 6.6 | 500.6 | 5.2 | Good | Poor |
| Developed Steel 3 | 15.39 | 3.300 | 6.5 | 512.2 | 6.3 | Good | Good |
| Developed Steel 4 | 19.24 | 4.107 | 5.2 | 531.8 | 5.2 | Good | Good |
| Comparative Steel 5 | 19.29 | 3.127 | 6.2 | 535.2 | 4.2 | Poor | Good |
| Developed Steel 5 | 12.61 | 4.563 | 5.5 | 572.2 | 5.2 | Good | Good |
| Comparative Steel 6 | 11.54 | 4.210 | 8.8 | 610.2 | 3.5 | Good | Good |
| Comparative Steel 7 | 11.82 | 4.252 | 6.6 | 540.0 | 4.6 | Good | Good |
| Comparative Steel 8 | 11.23 | 2.118 | 7.8 | 550.6 | 3.8 | Good | Good |
| Comparative Steel 9 | 10.80 | 1.525 | 8.5 | 571.1 | 2.7 | Good | Good |
| Developed Steel 6 | 16.16 | 3.863 | 5.2 | 533.4 | 7.4 | Good | Good |
| Comparative Steel 10 | 15.50 | 4.173 | 8.9 | 507.7 | 5.6 | Poor | Good |
| Comparative Steel 11 | 7.79 | 3.717 | 6.6 | 525.3 | 6.0 | Good | Poor |
| Developed Steel 7 | 11.35 | 3.158 | 7.1 | 529.0 | 6.9 | Good | Good |
| Developed Steel 8 | 10.68 | 3.998 | 7.2 | 532.2 | 6.5 | Good | Good |
| Comparative Steel 12 | 12.82 | 4.512 | 5.6 | 680.1 | 3.8 | Good | Good |
| Comparative Steel 13 | 9.66 | 4.330 | 4.8 | 513.0 | 7.9 | Poor | Poor |
| Developed Steel 9 | 11.81 | 4.079 | 6.6 | 529.7 | 6.7 | Good | Good |
| Developed Steel 10 | 11.90 | 3.796 | 7.5 | 535.5 | 5.6 | Good | Good |

Developed Steels 1 to 10 in Table 3 have a precipitation index of 10 or more, and as shown in Table 2, the area fraction of the recrystallized grains is 5% or less when the cold-rolled steel sheet is annealed at a temperature of 500° C. to $R_s$. Although the yield strength is high as 500 MPa due to the low area fraction of recrystallized grains, the dislocation density is low at $1.0\times10^{15}/m^2$ or less, so that strength and workability are simultaneously secured as a structural material having an elongation of 4% or more. In addition, Developed Steels 1 to 10 satisfy all the characteristics as a high-strength heat-resistant material because aging properties and heat resistance are good.

Comparative Steel 1 has the same composition system as Developed Steel 1, but was manufactured at an annealing temperature of less than 500° C., which is considerably low. As a result, recrystallization did not occur at all because the area fraction of recrystallized grains was 0%, the dislocation density was very high at $14.2\times10^{14}/m^2$, so that it is difficult to process Comparative Steel 1 because the yield strength was high at 650 MPa or more, but the elongation was very low at less than 2%.

Comparative Steels 2 and 3 have the same component system as Developed Steel 1, but were manufactured at an annealing temperature of 680° C. or higher, which exceeded the recrystallization initiation temperature. For this reason, the area fraction of recrystallized grains is high at 10% or more, the dislocation density is low at less than $3\times10^{14}/m^2$, and the elongation is high at 10% or more, but the yield strength is low at 450 MPa or less, so that Comparative Steels 2 and 3 have insufficient strength to be used as a structural material.

Comparative steel 4 has a very low C content of 0.0011%. For this reason, the content of C that may be precipitated as carbide is low, so that the precipitation index is very low at 6.4, and the recrystallization initiation temperature is low at 610° C. As a result, when annealing is performed at a temperature equal to or less than the recrystallization temperature, the yield strength or elongation is secured at an appropriate level immediately after manufacture, but the yield strength is significantly reduced because recrystallization occurs during heat treatment at 650° C., resulting in poor heat resistance.

In contrast, Comparative Steel 5 has a high content of C, a high precipitation index, a high recrystallization initiation temperature, and good strength, elongation, and heat resistance, but the aging properties are poor due to the solid solution C that is not precipitated and remains. When the aging properties are poor, the elongation gradually decreases due to the aging process, which makes processing difficult.

Comparative Steel 6 has a very high Mn of 1% or more. The addition of Mn results in the effect of increasing the strength by solid solution strengthening, so that the yield strength is high at 600 MPa or more. However, the elongation is low at less than 4%, so that excessive addition of Mn should be avoided.

Comparative Steel 7 is the case where the content of Mn is low. Other physical properties are satisfied, but there is a disadvantage in that hot rolling brittleness occurs.

Comparative Steels 8 and 9 have a high P content of 0.015% or more. It can be confirmed that as the content of P increases, the effect of increasing the yield strength appears. P is an element that can obtain a large strength improving effect even though P is added in a small amount, but when P is added in an excessive amount, the room temperature brittleness is increased, so that the elongation is decreased. When P is added at 0.015% or more, it can be confirmed that the elongation is reduced to less than 4%, so that the content of P is preferably less than 0.01% in terms of workability.

In Comparative Steel 10, N was added in a large amount exceeding 0.01%. Although N combines with Ti at a high temperature to be precipitated as TiN, Ti is relatively insufficient when N is added in an excessive amount, so that N may remain in a solid solution state. For this reason, Comparative Steel 9 has a disadvantage in that aging occurs. TiN also contributes to enhancing heat resistance by increasing the recrystallization temperature as a precipitate, but since the effect thereof is relatively small compared to other precipitates and an increase in amount of TiN precipitated causes a decrease in amount of TiC precipitated, it is preferred that the content of N does not exceed 0.01%.

Comparative Steel 11 has a very small Nb content of less than 0.01%, so that a precipitation index is less than 10. Nb is precipitated as NbC to reduce the size of crystal grains and significantly contribute to improving the recrystallization temperature, but in the case of Comparative Steel 11, the amount of Nb is small, so that the effect is insignificant. As a result, the recrystallization initiation temperature is as low as 620° C. It can be confirmed that the low recrystallization temperature causes recrystallization during high-temperature heat treatment, and thus, the heat resistance is poor.

In contrast, Comparative Steel 12 has so high content of Nb that the elongation is 3.8%, which is small. In addition, it could be confirmed that the load of hot rolling was excessively increased during the process.

Comparative Steel 13 has a small Ti content of less than 0.01%. As described above, Ti is precipitated as TiN and TiC, and thus contributes to the improvement of recrystallization, but when the amount is insignificant, the effect is reduced, so that the heat resistance is reduced. Furthermore, it can be confirmed that N cannot be sufficiently precipitated as TiN, N remains in the solid solution state and the aging has occurred.

The present invention is not limited to the Examples, but may be prepared in various forms, and a person with ordinary skill in the art to which the present invention pertains will understand that the present invention can be implemented in another specific form without changing the technical spirit or essential feature of the present invention. Therefore, it should be understood that the above-described examples are only illustrative in all aspects and not restrictive.

The invention claimed is:

1. A cold-rolled steel sheet having excellent heat resistance and moldability, comprising 0.002 to 0.01 wt % of C, 0.1 to 1.0 wt % of Mn, less than 0.01 wt % (except for 0 wt %) of P, 0.01 wt % or less (except for 0 wt %) of N, 0.01 to 0.05 wt % of Nb, and 0.01 to 0.08 wt % of Ti, with the balance being Fe and inevitable impurities, and having a microstructure in which an area fraction of recrystallized grains is 5 area % or less, and a dislocation density is $1\times10^{15}/m^2$ or less, wherein a precipitation index defined by the following Equation 1 is 10 or more:

$$\text{Precipitation index}=[\text{Min}([Ti], [N])+4\times\text{Min}([Nb], [C])+2\times\text{Min}([Ti]-[N], [C]-[Nb])]\times10^4 \quad \text{[Equation 1]}$$

where in Equation 1:

[Ti], [N], [Nb], and [C] are each a value obtained by dividing a content (wt %) of each component by each atomic weight thereof, and Min(A, B) is the smaller value of A and B, or, when Min(A, B) is a negative value, Min(A, B) is 0.

2. The cold-rolled steel sheet having excellent heat resistance and moldability of claim 1, further comprising one or more of 0.5 wt % or less (except for 0 wt %) of Si, 0.08 wt % or less (except for 0 wt %) of Al, and 0.01 wt % or less (except for 0 wt %) of S.

3. The cold-rolled steel sheet having excellent heat resistance and moldability of claim 1, wherein the cold-rolled steel sheet has a yield strength of 450 MPa or more.

4. The cold-rolled steel sheet having excellent heat resistance and moldability of claim 1, wherein the cold-rolled steel sheet has an elongation of 4% or more.

5. The cold-rolled steel sheet having excellent heat resistance and moldability of claim 1, wherein an aluminum-or zinc-plated layer is formed on a surface of the cold-rolled steel sheet.

6. The cold-rolled steel sheet having excellent heat resistance and moldability of claim 1, further comprising 0.042 to 0.5 wt % of Si.

* * * * *